US006945646B2

(12) United States Patent
Ogino et al.

(10) Patent No.: US 6,945,646 B2
(45) **Date of Patent: *Sep. 20, 2005**

(54) RECORDING MEDIUM

(75) Inventors: Hiroyuki Ogino, Yokohama (JP); Hitoshi Yoshino, Zama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/401,659

(22) Filed: Sep. 23, 1999

(65) Prior Publication Data

US 2002/0136865 A1 Sep. 26, 2002

(30) Foreign Application Priority Data

Sep. 25, 1998 (JP) ..... 10-271637

(51) Int. Cl.[7] ..... B41M 5/00; B41J 2/01; B05D 5/04

(52) U.S. Cl. ..... 347/105; 347/106; 427/146; 427/152; 428/32.25; 428/32.32; 428/32.37

(58) Field of Search ..... 428/32.25, 32.32, 428/32.37, 195, 328, 329, 331; 347/105, 106; 427/146, 152

(56) References Cited

U.S. PATENT DOCUMENTS

| | | | | |
|---|---|---|---|---|
| 4,242,271 | A | 12/1980 | Weber et al. | 260/448 AD |
| 4,879,166 | A | 11/1989 | Misuda et al. | 428/212 |
| 5,104,730 | A | 4/1992 | Misuda et al. | 428/304.4 |
| 5,679,451 | A | 10/1997 | Kondo et al. | 428/304.4 |
| 6,000,794 | A | 12/1999 | Kondo et al. | 347/105 |

FOREIGN PATENT DOCUMENTS

| | | |
|---|---|---|
| EP | 0 634 287 A1 | 1/1995 |
| EP | 0 701 904 A1 | 3/1996 |
| EP | 0 709 222 A1 | 5/1996 |
| EP | 0 742 108 A1 | 11/1996 |
| JP | 54-59936 | 5/1979 |
| JP | 55-5830 | 1/1980 |
| JP | 55-51583 | 4/1980 |
| JP | 2-276670 | 11/1990 |
| JP | 5-32413 | 2/1993 |
| JP | 5-32414 | 2/1993 |
| JP | 6-183131 | 7/1994 |
| JP | 7-76162 | 3/1995 |
| JP | 8-132731 | 5/1996 |
| JP | 9-30115 | 2/1997 |

OTHER PUBLICATIONS

Josef Roček, et al., "Porous Structure of Aluminium Hydroxide and its Content of Pseudoboehmite", Applied Catalysis, vol. 74, (1991) pp. 29–36.

*Primary Examiner*—Pamela R. Schwartz
(74) *Attorney, Agent, or Firm*—Fitzpatrick, Cella, Harper & Scinto

(57) ABSTRACT

A recording medium includes a substrate and an ink-receiving layer provided on the substrate, wherein the ink—receiving layer includes an alumina hydrate having a boehmite structure, an average particle thickness of 2.0 to 6.0 nm and a crystallite size of 5.0 to 8.0 nm in a direction of a (020) plane, and the recording medium has a degree of parallelization of 30 to 1,000.

9 Claims, No Drawings

RECORDING MEDIUM

BACKGROUND OF THE INVENTION

1. Field of the Invention

The present invention relates to a recording medium suitable for use in recording with inks and a production process thereof. In particular, the present invention relates to a recording medium for ink-jet printing, which can provide images high having optical density and bright in color tone, and has excellent ink-absorbing capacity, a production process thereof, and an image forming process using such a recording medium.

2. Related Background Art

In recent years, an ink-jet recording system, in which minute droplets of an ink are ejected by any one of various working principles to apply them to a recording medium such as paper, thereby making a record of images, characters and/or the like, has been quickly spread as a recording apparatus for various images in various applications including information instruments because it has features that recording can be conducted at high speed and with low noise, color images can be formed with ease, recording patterns are very flexible, and development and fixing process are unnecessary. Further, it begins to be applied to a field of recording of full-color images because images formed by a multi-color ink-jet system are comparable in quality with multi-color prints by a plate making system and photoprints by a color photographic system, and such printed images can be obtained at lower cost than the usual multi-color prints and photoprints when the number of copies is small.

With the improvement in recordability such as speeded-up and high-definition recording, and full-coloring of images in the ink-jet recording system, recording apparatus and recording methods have been improved, and recording media have also been required to have higher properties. In order to satisfy such requirements, a wide variety of recording media have heretofore been proposed. For example, Japanese Patent Application Laid-Open No. 55-5830 discloses paper for ink-jet recording, in which a coating layer having good ink absorbency is provided on a surface of a substrate, and Japanese Patent Application Laid-Open No. 55-51583 discloses that amorphous silica is used as a pigment in a coating layer.

Besides, recording sheets having an ink-receiving layer using an alumina hydrate of a pseudo-boehmite structure have been proposed in U.S. Pat. Nos. 4,879,166 and 5,104,730, and Japanese Patent Application Laid-Open Nos. 2-276670, 5-32413 and 5-32414.

Further, Japanese Patent Application Laid-Open No. 2-276670 discloses alumina sol which forms a needle-like alumina hydrate aggregate oriented in a certain direction when the alumina sol having a solids concentration of 7% by weight is diluted to 1/100 with purified water, and the diluted alumina sol is dropped on a hydrophilized collodion membrane and dried. Japanese Patent Application Laid-Open No. 7-76162 describes the fact that the b-axis of a boehmite crystal is preferably oriented perpendicularly to the plane of a sheet. Japanese Patent Application Laid-Open No. 9-30115 describes a recording medium having a specific pore structure and a degree of orientation of 0.5 or lower. Japanese Patent Application Laid-Open No. 8-132731 describes a recording medium having a degree of parallelization of 1.5 or higher. However, the conventional recording media have involved the following problems.

1. The conventional recording media using pseudo-boehmite have involved a problem that the resulting ink-receiving layer tends to cause haze. In order to cope with this problem, the ink-receiving layer is controlled to have to a specific pore structure as described in Japanese Patent Application Laid-Open No. 2-276670, or to orient a pore structure and boehmite crystals as described in Japanese Patent Application Laid-Open No. 9-30115. However, to lessen pores having a large radius in a recording medium may result in the impairment of ink absorbency, and the uniform orientation of the boehmite crystals has involved a problem that producing conditions are difficult to control.

2. Japanese Patent Application Laid-Open No. 7-76162 describes a recording medium in which a silica layer is laminated on a pseudo-boehmite layer. The idea described in the above document relates to the prevention of scratch marking by providing the silica layer. However, this method involves a problem that scratch marking is reduced, but blow marking cannot be prevented.

SUMMARY OF THE INVENTION

It is an object of the present invention to solve the above-described problems and to provide a recording medium which permits the choice of inks in a wide range, can provide images high in optical density, has good transparency and scarcely causes cracking, dusting and curling, a production process thereof, and an image forming process using such a recording medium.

The above object can be achieved by the present invention described below.

According to the present invention, there is thus provided a recording medium comprising a substrate and an ink-receiving layer provided on the substrate, wherein the ink-receiving layer comprises an alumina hydrate having a boehmite structure, an average particle thickness of 2.0 to 6.0 nm and a crystallite size of 5.0 to 8.0 nm in a direction of a (020) plane, and the recording medium has a degree of parallelization of 30 to 1000.

According to the present invention, there is also provided a process for producing a recording medium, which comprises the steps of mixing a slurry of an alumina hydrate having a boehmite structure, an average particle thickness of 2.0 to 6.0 nm and a crystallite size of 5.0 to 8.0 nm in a direction of a (020) plane, with a binder without drying the slurry to powder, applying the resultant mixture to a substrate, and drying the mixture.

According to the present invention, there is further provided an image forming process, comprising the step of ejecting an ink from minute orifices to apply the ink to the recording medium described above.

According to the present invention, there can be provided recording media which have both an ink solvent-absorbing ability and a coloring material-absorbing ability, permit the choice of inks and coloring materials in a wide range, provide images of even dot diameter, scarcely cause cracking and have excellent water resistance.

DESCRIPTION OF THE PREFERRED EMBODIMENTS

The alumina hydrate used in the present invention is preferred as a material used in an ink-receiving layer because it has a positive charge, so that a dye in an ink is well fixed and an image good in coloring is hence provided, and moreover there are no problems of bronzing of a black ink and light fastness. The alumina hydrate used in the recording medium is preferably an alumina hydrate showing a boehmite structure when analyzed by the X-ray diffractiometry because it has good coloring material-adsorbing ability, ink absorbency and transparency.

The alumina hydrate is defined by the following general formula:

$$Al_2O_{3-n}(OH)_{2n}\cdot mH_2O$$

wherein n is an integer of 0 to 3, and m is a number of 0 to 10, preferably 0 to 5. In many cases, $mH_2O$ represents an aqueous phase which does not participate in the formation of a crystal lattice, but is able to be eliminated. Therefore, m may take a value other than an integer. However, m and n are not 0 at the same time.

A crystal of the alumina hydrate showing a boehmite structure is generally a layer compound the (020) plane of which forms a macro-plane, and shows a characteristic diffraction peak. Besides a perfect boehmite, a structure called pseudo-boehmite and containing excess water between layers of the (020) plane may be taken. The X-ray diffraction pattern of this pseudo-boehmite shows a diffraction peak broader than that of the perfect boehmite. Since perfect boehmite and pseudo-boehmite may not be clearly distinguished from each other, alumina hydrates including both are called an alumina hydrate showing a boehmite structure (hereinafter referred to as the alumina hydrate) in the present invention unless expressly noted.

The present inventors previously proposed a recording medium using an alumina hydrate having a non- crystalline structure or boehmite structure. The present application is an improvement thereof and relates to a recording medium using an ultrahigh orienting alumina hydrate obtained by extremely enhancing the orienting ability of the alumina hydrate having a boehmite structure. When the degrees of orientation and parallelization are determined, this ultrahigh orienting alumina hydrate shows orienting ability extraordinarily higher than the conventional alumina hydrate. It has been found that when a binder is added to the ultrahigh orienting alumina hydrate to form an ink-receiving layer, the resulting recording medium is far improved in resistance to curling before printing, resistance to curling after printing, transparency and resistance to blow marking compared with the conventional recording media, thus leading to completion of the present invention. Since the ultrahigh orienting alumina hydrate has a self-orienting ability like liquid crystal materials, a film can be formed with the alumina hydrate alone without using any binder. By utilizing this nature, the present inventors have also found that when a mixed dispersion containing the ultrahigh orienting alumina hydrate and a binder is applied to a substrate and set like a gelatin material, productivity can be greatly improved, and that the surface defects of an ink-receiving layer formed by applying the dispersion are lessened. The recording media according to the present invention include all of a recording medium in which the ultrahigh orienting alumina hydrate is applied to a substrate to form an ink-receiving layer, a recording medium in which a coating formulation containing the ultrahigh orienting alumina hydrate is applied to a substrate in a thickness not enough to form a layer clearly, and a recording medium composed of paper made by adding the ultrahigh orienting alumina hydrate into a fibrous material.

No particular limitation is imposed on the production process of the ultrahigh orienting alumina hydrate used in the present invention so far as it is a process capable of producing an alumina hydrate having a boehmite structure. For example, the alumina hydrate can be produced by a method such as the hydrolysis of an aluminum alkoxide or sodium aluminate.

As an acid to be added to the ultrahigh orienting alumina hydrate, one or more acids may be freely selected from organic acids and inorganic acids. However, nitric acid is preferred from the viewpoints of the reaction efficiency of the hydrolysis, and easiness of the shape control and dispersion property of the resulting alumina hydrate.

The ultrahigh orienting alumina hydrate can be produced by controlling conditions (apparatus, temperature, time, kinds and amounts of additives, and pH of a solution) of the hydrolysis and deflocculation upon the production of an alumina hydrate and conditions (apparatus, temperature, pressure, number of times, reaction time, kind of a solvent, and pH of a solution) of hydrothermal synthesis.

The shape of an alumina hydrate can be determined by dispersing the alumina hydrate in water, alcohol or the like, dropping the resultant dispersion on a collodion membrane to prepare a sample for measurement, and observing this sample through a transmission electron microscope. As described in literature [Rocek J., et al., Applied Catalysis, Vol. 74, pp. 29–36 (1991)], it is generally known that pseudo-boehmite among alumina hydrates has both a needle form and another form. In the present invention, an alumina hydrate in the form of either a needle or a flat plate may be used. The shape (particle shape, particle diameter, aspect ratio) of the alumina hydrate can be determined by dispersing the alumina hydrate in ion-exchanged water, dropping the resultant dispersion on a collodion membrane to prepare a sample for measurement, and observing this sample through a transmission electron microscope.

According to a finding of the present inventors, the alumina hydrate in the flat plate form has better dispersibility in water than that of the needle form (ciliary form), and the orientation of particles of the alumina hydrate becomes random when an ink-receiving layer is formed therefrom, so that the pore volume of the ink-receiving layer increases, and the range of the pore radius distribution widens. Such an alumina hydrate is hence more preferred. The needle form as used herein refers to a state that molecules of an alumina hydrate in the form of a needle aggregate like a hair bundle with their sides in contact.

The most preferable shape of the alumina hydrate in the present invention is such that in the form of the flat plate, the average particle thickness is within a range of from 2.0 to 6.0 nm, and the average particle diameter is within a range of from 1 to 50 nm. In the case of the needle form on the other hand, it is preferred that the average particle diameter is within a range of from 2.0 to 6.0 nm, and the average particle length be within a range of from 1 to 50 nm. When the average particle thickness or average particle diameter falls within the above range, the self-film-forming property and orienting ability of the alumina hydrate can be improved, so that the occurrence of coating defects, curling before printing and curling after printing in the resulting recording medium is prevented. The more preferable range of the average particle thickness or average particle diameter is a range of from 2.0 to 5.0 nm, since spaces are defined between particles of the alumina hydrate, and so the ink absorbency of the resulting ink-receiving layer can be improved. The most preferable range is a range of from 3.0 to 5.0 nm, within which a porous structure that the range of the pore radius distribution is wide can be formed with ease. Such an alumina hydrate can improve the transparency of the resulting ink-receiving layer and the coloring of images printed thereon.

The crystal structure of the alumina hydrate can be determined by general X-ray, diffractometry. More specifically, the alumina hydrate, a recording medium provided with an ink-receiving layer containing this alumina hydrate, or a recording medium containing the alumina hydrate therein is set: to a measuring cell to measure a peak which appears at a diffraction angle 2θ of 14 to 15°, whereby a crystallite size in a direction of a (020) plane (hereinafter referred to "crystallite size") can be found in accordance with the Scherrer's formula $$E=0.9\lambda/B\cos\theta \quad [1]$$

wherein λ is a wavelength of an X-ray, 2θ is a diffraction angle at the peak, and B is a half breadth of the peak.

In the present invention, the crystallite size is within a range of from 5.0 to 8.0 nm. When the crystallite size falls within this range, the transparency of the resulting recording medium can be improved without impairing the self-film-forming property of the alumina hydrate.

The crystallite size is preferably greater than the average particle thickness or average particle diameter, since the occurrence of bleeding and cissing can be prevented. More preferably, the difference between the crystallite size and the average particle thickness or average particle diameter is at least 1 nm. When the difference satisfies this limitation, the resulting recording medium finds it hard to undergo dusting and cracking when it is folded. The most preferable difference between the crystallite size and the average particle thickness or average particle diameter is at least 2 nm. When the difference satisfies this limitation, the occurrence of beading and a whitish haze on an image printed on the resulting recording medium can be prevented.

The term "bleeding" as used herein means that when solid printing is conducted at a fixed area on a recording medium, a portion colored with a dye becomes wider (greater) than a printed area. The term "beading" refers to a phenomenon that a particulate-concentration irregularity appears due to aggregation of ink droplets caused at a solid printed area. The term "cissing" means that portions not colored occur in a solid printed area. The term "whitish haze" means that an image printed looks hazy white.

The degree of parallelization in the recording medium according to the present invention is within a range of 30 to 1,000. When the degree of parallelization falls within this range, the occurrence of coating defects, curling before printing and curling after printing in the recording medium is prevented. The degree of parallelization is more preferably within a range of 50 to 800, since blow marks are hard to be left on the ink-receiving layer, and the coloring ability of the ink-receiving layer is improved to make a color at a color-mixed area, such as a secondary color, good. In the present invention, the degree of parallelization is determined by subjecting a recording medium and powder thereof to X-ray diffraction to find their respective peaks at a (020) plane and another plane, separately finding an intensity ratio between 2 peaks on both samples and comparing these intensity ratios with each other. No limitation is imposed on the reference peak so far as it has a sufficient intensity that it is not hidden by the peak of the base, like a combined peak of a (200) plane and a (051) plane, or a peak at a (120) plane. The above combined peak is preferred.

In another embodiment of the recording medium according to the present invention, an additional porous layer may be formed on the porous layer comprising the ultrahigh orienting alumina hydrate and a binder. Any material may be used for the upper layer so far as it is a material capable of forming a porous layer. For example, the material can be chosen for use from the group consisting of magnesia, magnesium carbonate, calcium carbonate, silica and silica alumina. Of these, silica is most preferred. When a porous layer containing silica is provided as the upper layer, the ink-receiving layer makes it hard to leave scuff marks on the surface thereof, and moreover the ink-absorbing speed of the ink-receiving layer is increased. As the silica to be used, any of silica sol (colloidal silica) in which primary particles are monodispersed, colloidal particles of silica composed of secondary particles obtained by aggregating primary particles, gel type silica, and precipitated silica may be used. Either a dry process or a wet process may be used as the production of the silica. The shape of the silica used may be either, for example, spherical or non-spherical. No particular limitation is imposed on the particle diameter of the silica. However, it is preferably within a range of from 3 to 200 nm. When the particle diameter falls within this range, the ink absorbency and transparency of the resulting recording medium can be reconciled with each other. Two or more kinds of silica may also be used in combination. In this case, a combination of the inorganic fine particles having a particle diameter of 20 nm or smaller and a particle diameter within a range of from 40 to 200 nm is desirable from the viewpoints of the prevention of cracking and good transparency. As described in Japanese Patent Application Laid-Open No. 6-183131, silica having a particle diameter of 20 nm or smaller may also be used as a binder. The particle diameter of the silica is more preferably 100 nm or smaller because no surface disorder occurs after printing, and the roundness of printed dots is made better.

The BET specific surface area, the pore radius distribution and the pore volume of the ink-receiving layer of the recording medium according to the present invention can be determined by the nitrogen adsorption and desorption method. The BET specific surface area is preferably within a range of from 70 to 300 $m^2/g$. If the BET specific surface area is smaller than the lower limit of the above range, the resulting ink-receiving layer becomes opaque white, or its adsorption sites to a dye in an ink becomes insufficient, so that the water fastness of an image printed thereon may become insufficient in some cases. If the BET specific surface area is greater than the upper limit of the above range, the resulting ink-receiving layer becomes easy to cause cracking. The ink-receiving layer preferably has a structure that a maximum peak in the pore radius distribution (peak pore radius) thereof is present within a range of from 5.0 to 10.0 nm in radius. When the peak is present within this range, the transparency and ink absorbency of the resulting recording medium can be improved. A more preferred range in radius is a range of from 5.0 to 8.0 nm. When the peak is present within this range, the resolution of an image to be formed on the resulting ink-receiving layer is improved, and the tint of a black ink is kept constant irrespective of concentration. Further, the total pore volume of the ink-receiving layer is preferably within a range of from 0.35 to 1.0 $cm^3/g$, more preferably from 0.4 to 1.0 $cm^3/g$ because ink absorbency is improved irrespective of the kind of ink. A still more preferred range is a range of from 0.4 to 0.6 $cm^3/g$. When the total pore volume falls within this range, the tint at a color-mixed area in an image formed is improved. The pore volume of the ink receiving layer is preferably at least 8 $cm^3/m^2$. If the pore volume is smaller than this limit, inks tend to run out of the ink-receiving layer when multi-color printing is conducted, and so bleeding occurs on an image formed.

The pore structure and the like of the ink receiving layer are not determined only by the alumina hydrate used, but are changed by various production conditions such as the kind and mixing amount of the binder, the concentration, viscosity and dispersion state of the coating formulation, the coating equipment, the coating head, the coating weight, and the flow rate, and the temperature and blowing direction of drying air. It is therefore necessary to control the production conditions within the optimum limits for achieving the intended properties of the ink-receiving layer according to the present invention. In the present invention, a slurry of the alumina hydrate is mixed with a binder without drying the slurry to powder, and the resultant mixture is applied to a substrate, thereby producing a recording medium.

As the binder used in the present invention, one or more materials may be freely chosen for use from among water-soluble polymers. For example, preference may be given to polyvinyl alcohol or modified products thereof, starch or modified products thereof, gelatin or modified products thereof, casein or modified products thereof, gum arabic, cellulose derivatives such as carboxymethyl cellulose, polyvinyl pyrrolidone, maleic anhydride polymers or copolymers thereof, water-soluble polymers such as acrylic ester copolymers, conjugated diene copolymer latexes such as SBR latexes, functional group-modified polymer latexes, vinyl copolymer latexes such as ethylene-vinyl acetate copolymers, and the like.

The mixing ratio by weight of the alumina hydrate to the binder is preferably within a range of from 5:1 to 20:1. When the mixing ratio falls within this range, the ink-absorbing speed of the resulting recording medium is increased, and the optical density of an image printed thereon can be heightened. If the amount of the binder is less than the lower limit of the above range, the mechanical strength of the resulting ink-receiving layer becomes insufficient, and the ink-receiving layer tends to cause cracking and dusting. If the amount is greater than the upper limit of the above range, the pore volume of the resulting ink-receiving layer is reduced, resulting in a printing medium having poor ink absorbency. The mixing ratio is more preferably within a range of from 7:1 to 15:1 taking into consideration the points that ink absorbency is improved, and cracking is hard to occur when the resulting recording medium is folded.

In the present invention, pigment dispersants, thickeners, pH adjustors, lubricants, flowability modifiers, surfactants, antifoaming agents, water-proofing agents, foam suppressors, releasing agents, foaming agents, penetrants, coloring dyes, optical whitening agents, ultraviolet absorbents, antioxidants, antiseptics and mildewproofing agents may be added in addition to the alumina hydrate and binder, as needed. The water-proofing agents may be freely chosen for use from among the known substances such as quaternary ammonium halides and quaternary ammonium salt polymers.

No particular limitation is imposed on the substrate used for forming the ink-receiving layer thereon so far as it is a sheet-like substance, for example, a paper web such as suitably sized paper, water leaf paper or resin-coated paper making use of polyethylene or the like, or a thermoplastic film. In the case of the thermoplastic film, there may be used transparent films such as films of polyester, polystyrene, polyvinyl chloride, polymethyl methacrylate, cellulose acetate, polyethylene and polycarbonate, as well as opaque sheets opacified by the filling of a pigment or the formation of minute foams.

As a process of the dispersion treatment for a dispersion containing the alumina hydrate, any process may be chosen for use from among the processes generally used in dispersion. As a method and apparatus to be used, mild stirring by a homomixer, rotary blade or the like is preferred to stirring by a grinder type dispersing machine such as a ball mill or sand mill.

Although shearing stress applied varies according to the viscosity, amount and volume of the dispersion, it is preferably within a range of from 0.1 to 100.0 $N/m^2$ (1 to 1,000 $dyn/cm^2$). When the shearing stress falls within the above range, the viscosity of the alumina hydrate dispersion can be reduced without changing the crystal structure of the alumina hydrate. In addition, the particle diameter of the alumina hydrate can be made sufficiently small, so that binding points between the alumina hydrate, and the binder, substrate and fibrous substance are increased. Therefore, the occurrence of cracking and dusting can be prevented. If the shearing stress exceeds the upper limit of the above range, the dispersion undergoes gelation, or the crystal structure of the alumina hydrate is changed to an amorphous form. If the shearing stress is lower than the lower limit of the above range, dispersion becomes insufficient, so that the resulting dispersion tends to generate precipitate, aggregated particles are left in the resulting recording medium to cause haze, thereby lowering the transparency of the recording medium, and the recording medium tends to cause separation of the particles and cracking.

Shearing stress ranging from 0.1 to 50.0 $N/m^2$ is more preferred because the pore volume of the alumina hydrate is not decreased, and moreover aggregated particles of the alumina hydrate can be broken into fine particles, so that the formation of pores having a greater radius in the resulting recording medium can be prevented to prevent separation and cracking of the ink-receiving layer when the recording medium is folded, and the occurrence of haze due to great particles in the recording medium can be reduced. Shearing stress ranging from 0.1 to 20.0 $N/m^2$ is most preferred because the mixing ratio of the alumina hydrate to the binder in the resulting recording medium can be kept constant to prevent the occurrence of dusting and cracking, and moreover the optical density and dot diameter of dots printed on the recording medium can be made even.

Although the dispersing time varies according to the amount of the dispersion, the size of a container, the temperature of the dispersion, and the like, it is preferably 30 hours or shorter from the viewpoint of preventing the change of the crystal structure. When the dispersing time is 10 hours or shorter, the pore structure can be kept within the above ranges. During the dispersion treatment, the temperature of the dispersion may be kept constant by conducting cooling or heat retaining. Although ea preferable temperature range varies according to the process of the dispersion treatment, and materials and viscosity of the dispersion, it is within a range of from 10 to 100° C. If the temperature is lower than the lower limit of the above range, the dispersion treatment becomes insufficient, or aggregation occurs. If the temperature is higher than the upper limit of the above range, the dispersion undergoes gelation, or the crystal structure is changed to an amorphous form.

In the present invention, as a coating process of the dispersion comprising the alumina hydrate in the case where an ink-receiving layer is formed, there may be used a generally-used coating technique using a blade coater, an air knife coater, a roll coater, a brush coater, a curtain coater, a bar coater, a gravure coater, a sprayer or the like.

The coating weight of the dispersion is preferably within a range of from 0.5 to 60 $g/m^2$ in terms of dry solids content from the viewpoint of good ink absorbency. The coating weight is more preferably within a range of from 5 to 45 $g/m^2$. When the coating weight falls within this range, the ink-absorbing speed of the resulting recording medium is increased, and the cracking and curling of the recording medium can be prevented. The surface smoothness of the ink-receiving layer may also be improved by means of calender rolls or the like as needed.

Inks used in the image forming process according to the present invention comprises principally a coloring material (dye or pigment), a water-soluble organic solvent and water. As another embodiment, a lipophilic solvent may also be used. Preferable examples of the dye include water-soluble dyes represented by direct dyes, acid dyes, basic dyes, reactive dyes and food colors. However, any dyes may be used so far as they provide images satisfying the required performance such as fixing ability, coloring ability, brightness or clearness, stability, light fastness and the like in combination with the above-described recording media. Carbon black or the like is preferred as the pigment. As a method of using a pigment and a dispersant in combination, a method using a self-dispersing type pigment or a microcapsulizing method may also be used.

The water-soluble dyes are generally used in a form dissolved in water or a solvent comprising water and at least one water-soluble organic solvent. As a preferable solvent component for these dyes, there may be used a mixed solvent comprising water and at least one of various water-soluble organic solvents. It is however preferable to control the content of water in an ink within a range of from 20 to 90% by weight.

Examples of the water-soluble organic solvents include alkyl alcohols having 1 to 4 carbon atoms, such as methyl alcohol; amides such as dimethylformamide; ketones and keto-alcohols such as acetone; ethers such as tetrahydrofuran; polyalkylene glycols such as polyethylene glycol; alkylene glycols the alkylene moiety of which has 2 to 6 carbon atoms, such as ethylene glycol; glycerol; lower alkyl ethers of polyhydric alcohols, such as ethylene glycol methyl ether; and the like. Among these many water-soluble organic solvents, the polyhydric alcohols such as diethylene glycol, and the lower alkyl ethers of polyhydric alcohol, such as triethylene glycol monomethyl ether and triethylene glycol monoethyl ether are preferred. The polyhydric alcohols are particularly preferred because they have an effect as a lubricant for preventing the clogging of nozzles, which is caused by the evaporation of water in an ink and hence the deposition of a water-soluble dye.

A solubilizer may be added to the inks. Nitrogen-containing heterocyclic ketones are typical solubilizers. Its object is to highly enhance the solubility of the water-soluble dye in the solvent. For example, N-methyl-2-pyrrolidone and 1,3-dimethyl-2-imidazolidinone are preferably used. In order to further improve the properties of inks, additives such as viscosity modifiers, surfactants, surface tension modifiers, pH adjustors and resistivity regulative agents may be added.

A method for forming an image by applying the above-described inks to the recording medium is performed by an ink-jet recording method. As such a method, any system may be used so far as it can effectively eject an ink from a nozzle to apply it to the recording medium. In particular, an ink-jet recording system described in Japanese Patent Application Laid-Open No. 54-59936, in. which an ink undergoes a rapid volumetric change by an action of thermal energy applied to the ink, so that the ink is ejected from a nozzle by the working force generated by this change of state, may be used effectively.

Further, the recording media according to the present invention may be used to form images by an electrophotographic system or any of various printing techniques such as gravure printing, offset printing and screen printing.

The present invention will hereinafter be described more specifically by the following examples. However, the present invention is not limited to these examples.

The measurements of various properties as described herein were conducted in accordance with the following respective methods.

1. Particle Shape [Average Particle Thickness (nm) or Average Particle Diameter (nm)]:

An alumina hydrate slurry or an ink-receiving layer containing an alumina hydrate separated from a recording medium sample was dispersed in ion-exchanged water, and the resultant dispersion was dropped on a collodion membrane to prepare a sample for measurement. This sample was observed through a transmission type electron microscope (H-500, trade name, manufactured by Hitachi Ltd.) to find an average particle thickness or average particle diameter.

2. Crystallite Size (nm):

Powder obtained by drying an alumina hydrate slurry at 100° C. for 8 hours, or powder of an ink-receiving layer separated from a recording medium sample was thoroughly ground in an agate mortar to prepare a powder sample. The sample was placed on a sample carrier to subject it to X-ray diffractometer (RAD-2R, trade name, manufactured by RIGAKU CORPORATION), thereby finding a half breadth at a (020) plane. The crystallite size was determined in accordance with the Scherrer's formula.

3. Self-film-forming Property of Alumina Hydrate Slurry:

An alumina hydrate slurry was applied to a transparent PET film (Melinex 705, trade name, product of Du Pont Co.) having a thickness of 100 $\mu$m by a die coating process so as to give a dry coating thickness of 10 $\mu$m and then dried at 100° C. for 20 minutes. The coating surface was visually observed to evaluate the alumina hydrate slurry as to the self-film-forming property in accordance with the following standard:

AA: None of coating defects were observed, and a fine continuous film was formed;

A: Cracks 5 mm or smaller in length were present, but a comparatively good continuous film was formed;

B: Cracks greater than 5 mm in length were present, but a continuous film was formed;

C: Cracks were continuous, and no continuous film was formed.

4. Degree of Parallelization of Recording Medium:

With respect to a recording medium sample, peak intensity of a (020) plane and combined peak intensity of (051) and (200) planes in X-ray diffraction were measured. An ink-receiving layer separated from the recording medium was thoroughly ground in an agate mortar to prepare a powder sample. The combined peak intensity of this powder sample was measured likewise. The degree of parallelization was determined from these measured results in accordance with the following formulae.

Intensity ratio of powder=(Peak intensity of the (020) plane of the powder)/(Combined peak intensity of the (051) and (200) planes of the powder)

Intensity ratio of recording medium (sheet form)=(Peak intensity of the (020) plane of the medium)/(Combined peak intensity of the (051) and (200)planes of the medium)

Degree of parallelization=(Intensity ratio of the recording medium (ink-receiving layer))/(Intensity ratio of the powder).

5. Pore Volume and Peak Pore Radius of Recording Medium:

After a recording medium sample was thoroughly heated and deaerated, measurement was conducted using the nitrogen adsorption and desorption method.

Measuring apparatus: Autosorb 1 (trade name, manufactured by Quanthachrome Co.).

6. Ink Absorbency:

Using an ink-jet printer equipped with four ink-jet heads for yellow (Y), magenta (M), cyan (C) and black (Bk) inks, each of which has 128 nozzles at intervals of 16 nozzles per mm, ink-jet recording was performed on a recording medium sample in an ink quantity of 30 ng per dot with inks having their corresponding compositions described below, thereby evaluating the recording medium as to ink absorbency. Ink composition

| | |
|---|---|
| Ink dyes (Y, M, C and Bk) | 5 parts each |
| Ethylene glycol | 9 parts |
| Polyethylene glycol | 11 parts |
| Water | 75 parts |

Ink dyes
Y: C.I. direct yellow 86
M: C.I. acid red 35
C: C.I. direct blue 199
Bk: C.I. food black 2

Using the yellow, magenta, cyan and black inks, single-color or multi-color solid printing was conducted on the recording medium. Right after the printing, the drying condition of the inks on the surface of the recording medium was determined by touching the printed area with a finger. The quantity of each ink in the single-color printing was determined as 100% (16×16 dots per $mm^2$). Similarly, overlap printing was performed with 3 color inks (each 100%). The ink absorbency was ranked in accordance with the following standard.

AA: No ink adhered to the finger in an ink quantity of 300%;

A: No ink adhered to the finger in an ink quantity of 200%;

B: No ink adhered to the finger in an ink quantity of 100%;

C: Some ink adhered to the finger in an ink quantity of 100%.

7. Transparency of Recording Medium:

The total light transmittance of each recording medium produced was measured by means of a hazeometer (NDH-1001DP, trade name, manufactured by Nippon Denshoku K.K.) in accordance with JIS K-7105. The transparency was ranked in accordance with the following standard.

AA: Transmittance of at least 75%;

A: Transmittance of at least 70%;

B: Transmittance of at least 60%;

C: Transmittance lower than 60%;

8. Resistance to Curling After Printing of Recording Medium:

Each recording medium produced was cut into a size of 297 by 210 mm, and solid printing was conducted in an ink quantity of 300% in the same manner as in the evaluation of ink absorbency with 20-mm blank spaces left at all peripheral sides of the recording medium. The recording medium thus printed was placed on a flat table with the ink-receiving layer turned upward to measure the height of warpage by a height gauge. The resistance to curling of the recording medium was ranked in accordance with the following standard.

AA: Warpage was not more than 0.2 mm;

A: Warpage was not more than 1 mm;

B: Warpage was not more than 5 mm;

C: Warpage was more than 5 mm.

9. Coating Defects of Recording Medium:

The coating defects of each recording medium produced were visually evaluated in accordance with the following standard.

AA: No coating defect was; observed;

A: Cracks not longer than 1 mm occurred in a proportion of at most 5 cracks per 297×210 mm;

B: Cracks not longer than 1 mm occurred in a proportion of at most 20 cracks per 297×210 mm;

C: Cracks longer than 1 mm occurred.

10. Resistance to Curling Before Printing of Recording Medium (Curling of Blank Sheet):

Each recording medium produced was cut into a size of 297 by 210 mm, and placed on a flat table with the ink-receiving layer turned downward to measure the height gauge in an environment of 5° C. and 10% RH. The resistance to curling of the recording medium was ranked in accordance with the following standard.

AA: Warpage was not more than 0.1 mm;

A: Warpage was not more than 0.5 mm;

B: Warpage was not more than 1 mm;

C: Warpage was more than 1 mm.

11. Resistance to Blow Marking

Each recording medium produced was brought into close contact with a glass plate with the ink-receiving layer turned upward, and a pencil (Uni Series, trade name, product of Mitsubishi Pencil Co., Ltd.) rounded off at one end thereof was dropped on the recording medium from a height of 20 cm with the rounded end turned downward. Whether some blow mark was left on the recording medium or not at this time was visually observed to rank the resistance to blow marking in accordance with the following standard.

AA: No blow mark was observed;

A: A blow mark not greater than 1 mm in diameter was observed;

B: A blow mark not greater than 2 mm in diameter was observed;

C: A blow mark greater than 2 mm in diameter was observed.

12. Folding Test:

Each recording medium produced was wound in close contact around a column 10 mm in diameter with the ink-receiving layer outside and folded at an angle of 180°. The condition of the ink-receiving layer at this time was visually observed to evaluate it in accordance with the following standard.

AA: No change was observed;

A: A crack not longer than 3 mm was observed in parallel with the fold curve;

B: A crack not shorter than 3 mm was observed in parallel with the fold curve, but no separation of the ink-receiving layer from the substrate (PET) was observed;

C: Separation of the ink-receiving layer from the substrate (PET), which was attendant on a crack caused in parallel with the fold curve, was observed.

EXAMPLE 1

Aluminum sec-butoxide was prepared in accordance with the process described in U.S. Pat. No. 4,242,271. A mixed solution of the aluminum sec-butoxide and 75% by weight sec-butyl alcohol was hydrolyzed at 85° C. with a mixed solution of sec-butyl alcohol containing 30% by weight of water at a velocity gradient of 5,000 $cm^{-1}$ in a vessel equipped with a stirrer to prepare an alumina hydrate slurry.

After this alumina hydrate slurry was aged at 125° C. for 3 hours in an electromagnetic stirring type autoclave, water was immediately added to the alumina hydrate slurry until the solids content of alumina hydrate was 20% by weight, to cool it. The pH of the alumina hydrate slurry was adjusted with a 3.8% aqueous nitric acid solution to obtain a slurry of an alumina hydrate having a boehmite structure. The physical property values of the thus-obtained slurry of the alumina hydrate having the boehmite structure were determined in accordance with the above-described respective methods. The results are shown in Table 1.

Polyvinyl alcohol (Gohsenol GH23, trade name, product of The Nippon Synthetic Chemical Industry Co., Ltd.) was dissolved or dispersed in ion-exchanged water to obtain a 10% by weight solution. The polyvinyl alcohol solution and the alumina hydrate slurry obtained by the above-described process were weighed out so as to give a weight ratio of 1:15 in terms of solids content and mixed with each other while stirring for 30 minutes at 8,000 rpm by means of a homomixer (manufactured by Tokushu Kika Kogyo Co., Ltd.), thereby obtaining a mixed dispersion. The mixed dispersion was applied by a die coating process onto a transparent PET film (Lumirror, trade name, product of Toray Industries, Inc.) having a thickness of 100 $\mu$m. The PET film on which the mixed dispersion had been coated was placed into an oven (manufactured by YAMATO SCIENTIFIC CO., LTD.) to heat and dry it at 100° C. for 30 minutes, thereby obtaining a recording medium in which an ink-receiving layer having a thickness of 39 $\mu$m was formed. The physical property values of the ink-receiving layer were determined in accordance with the above-described respective methods. The results are shown in Table 1.

EXAMPLES 2 to 7

Slurries of alumina hydrates having a boehmite structure were obtained in the same manner as in Example 1 except that the temperature and stirring velocity (velocity gradient) upon the hydrolysis, the temperature and time upon the aging, and the quenching operation with diluent ion-exchanged water (when no quenching was conducted, the slurry was allowed to cool down to room temperature after the aging and then diluted) in Example 1 were changed to their corresponding conditions shown in Table 1. The physical property values of the respective alumina hydrate slurries thus obtained were determined in accordance with the above-described respective methods. The results are shown in Table 1. Recording media, in which an ink-receiving layer was formed, were obtained in the same manner as in Example 1 except that these alumina hydrate slurries were respectively used. The physical property values of the respective ink-receiving layers were determined in accordance with the above-described respective methods. The results are shown in Table 1.

EXAMPLES 8 and 9

Alumina hydrate slurries were obtained in the same manner as in Example 1 except that $Na_2SiO_3$ was added as a shape-controlling agent to the alumina hydrate slurry prepared in Example 1 in such a manner that the weight ratio of the alumina hydrate slurry to $Na_2SiO_3$ was 10:0.05 in terms of solids content, and the aging time was changed as shown in Table 1. The physical property values of the respective alumina hydrate slurries thus obtained were determined in accordance with the above-described respective methods. The results are shown in Table 1. Recording media, in which an ink-receiving layer was formed, were obtained in the same manner as in Example 1 except that these alumina hydrate slurries were respectively used. The physical property values of the respective ink-receiving layers were determined in accordance with the above-described respective methods. The results are shown in Table 1.

COMPARATIVE EXAMPLES 1 and 2

Slurries of alumina hydrates having a boehmite structure were obtained in the same manner as in Example 1 except that the stirring velocity (velocity gradient) upon the hydrolysis, the temperature and time upon the aging, and the quenching operation with diluent ion- exchanged water (when no quenching was conducted, the slurry was allowed to cool down to room temperature after the aging and then diluted) in Example 1 were changed to their corresponding conditions shown in Table 1. The physical property values of the respective alumina hydrate slurries thus obtained were determined in accordance with the above-described respective methods. The results are shown in Table 1. Recording media, in which an ink-receiving layer was formed, were obtained in the same manner as in Example 1 except that these alumina hydrate slurries were respectively used. The physical property values of the respective ink-receiving layers were determined in accordance with the above-described respective methods. The results are shown in Table 1.

COMPARATIVE EXAMPLE 3

An alumina hydrate slurry was obtained in the same manner as in Example 8 except that $Na_2SiO_3$ was added as a shape-controlling agent to the alumina hydrate slurry prepared in Example 1 in such a manner that the weight ratio of the alumina hydrate slurry to $Na_2SiO_3$ was 10:0.05 in terms of solids content. The physical property values of the alumina hydrate slurry thus obtained were determined in accordance with the above-described respective methods. The results are shown in Table 1. A recording medium, in which an ink-receiving layer was formed, was obtained in the same manner as in Example 1 except that this alumina hydrate slurry was used. The physical property values of the ink-receiving layer were determined in accordance with the above-described respective methods. The results are shown in Table 1.

COMPARATIVE EXAMPLE 4

A slurry of an alumina hydrate having a boehmite structure was obtained in the same manner as in Example 1 except that the mixed solution of sec-butyl alcohol containing 30% by weight of water used in the hydrolysis was changed to ion-exchanged water. The physical property values of the alumina hydrate slurry thus obtained were determined in accordance with the above-described respective methods. The results are shown in Table 1. A recording medium, in which an ink-receiving layer was formed, was obtained in the same manner as in Example 1 except that this alumina hydrate slurry was used. The physical property values of the ink-receiving layer were determined in accordance with the above-described respective methods. The results are shown in Table 1.

TABLE 1

| | Example | | | | | | | |
|---|---|---|---|---|---|---|---|---|
| | 1 | 2 | 3 | 4 | 5 | 6 | 7 | 8 |
| (Conditions of synthesis) | | | | | | | | |
| Hydrolyzing temperature (° C.) | 85 | 85 | 85 | 85 | 85 | 90 | 80 | 85 |
| Velocity gradient ($cm^{-1}$) | 5000 | 5000 | 1000 | 5000 | 5000 | 5000 | 5000 | 5000 |
| Aging temperature (° C.) | 125 | 60 | 60 | 125 | 135 | 125 | 125 | 125 |
| Aging time | 3 hrs | 5 days | 24 hrs | 5 hrs | 6 hrs | 2 hrs | 1 hr | 3 hrs |
| Quenching | Carried out | Not | Not | Carried out | Carried out | Carried out | Carried out | Carried out |
| (Physical properties of slurry) | | | | | | | | |
| Average particle thickness (nm) | 4.5 | 5 | 2 | 5 | 6 | 4.2 | 3 | 4.2 |
| Crystallite size (nm) | 5.5 | 5.2 | 2 | 6.4 | 8 | 5.2 | 5 | 5.6 |
| Average particle diameter (nm) | 21.1 | 20.3 | 16.5 | 22.5 | 23.2 | 28 | 19.5 | 22.8 |
| Self-film-forming property | AA | A | B | AA | A | AA | AA | AA |

| | Example | | | | | | | |
|---|---|---|---|---|---|---|---|---|
| | 1 | 2 | 3 | 4 | 5 | 6 | 7 | 8 |
| (Physical properties of recording medium) | | | | | | | | |
| Average particle thickness (nm) | 4.5 | 5 | 2 | 5 | 6 | 4.2 | 3 | 4.2 |
| Crystallite size (nm) | 5.5 | 5.2 | 2 | 6.4 | 8 | 5.2 | 5 | 5.6 |
| Degree of parallelization | 500 | 100 | 30 | 450 | 50 | 700 | 850 | 800 |
| Pore volume (cc/g) | 0.51 | 0.52 | 0.34 | 0.6 | 0.7 | 0.4 | 0.36 | 0.53 |
| Peak pore radius (nm) | 6.7 | 6.8 | 4.2 | 8.5 | 10 | 4.9 | 4.6 | 6.9 |
| Ink absorbency | AA | AA | B | AA | AA | A | A | AA |
| Transparency | A | A | AA | A | B | AA | AA | AA |
| Resistance to curling after printing | AA | A | B | AA | A | AA | AA | AA |
| Coating defects (cracking) | AA | A | A | AA | A | AA | AA | AA |
| Resistance to curling before printing | A | A | A | A | A | A | A | A |
| Resistance to blow marking | AA | A | B | AA | B | AA | AA | AA |
| Folding test | AA | A | B | AA | B | AA | AA | AA |

| | Example | Comparative Example | | | |
|---|---|---|---|---|---|
| | 9 | 1 | 2 | 3 | 4 |
| (Conditions of synthesis) | | | | | |
| Hydrolyzing temperature (° C.) | 85 | 85 | 85 | 85 | 85 |
| Velocity gradient ($cm^{-1}$) | 5000 | 1000 | 5000 | 5000 | 5000 |
| Aging temperature (° C.) | 125 | 60 | 125 | 125 | 125 |
| Aging time | 1 hr | 5 days | 3 hrs | 0.5 hrs | 3 hrs |
| Quenching | Carried out | Not | Not | Carried out | Carried out |
| (Physical properties of slurry) | | | | | |
| Average particle thickness (nm) | 2 | 5.2 | 5.4 | 1.9 | 7 |
| Crystallite size (nm) | 5 | 5.2 | 5.2 | 4.2 | 6.9 |
| Average particle diameter (nm) | 19.4 | 20.9 | 23.2 | 19.5 | 29.2 |
| Self-film-forming property | AA | C | C | AA | C |

| | Example | Comparative Example | | | |
|---|---|---|---|---|---|
| | 9 | 1 | 2 | 3 | 4 |
| (Physical properties of recording medium) | | | | | |
| Average particle thickness (nm) | 2 | 5.2 | 5.4 | 1.9 | 7 |
| Crystallite size (nm) | 5 | 5.2 | 5.2 | 4.2 | 6.9 |
| Degree of parallelization | 1000 | 20 | 7 | 1500 | 5 |
| Pore volume (cc/g) | 0.35 | 0.45 | 0.45 | 0.35 | 0.6 |
| Peak pore radius (nm) | 4.5 | 6 | 5.8 | 4.5 | 8.5 |
| Ink absorbency | A | A | A | B | AA |
| Transparency | AA | A | A | AA | A |
| Resistance to curling after printing | AA | C | C | AA | C |
| Coating defects (cracking) | AA | C | C | AA | C |
| Resistance to curling before printing | B | A | A | C | A |
| Resistance to blow marking | AA | C | C | AA | C |
| Folding test | AA | C | C | AA | C |

EXAMPLE 10

An aqueous dispersion containing polyvinyl alcohol (GH-23, trade name, product of The Nippon Synthetic Chemical Industry Co., Ltd.) at a solids concentration of 10% by weight; and colloidal silica (Snowtex OL, trade name, product of Nissan Chemical Industries, Ltd.) were mixed with each other so as to give a mixing ratio of 1:3 in terms of solids content, and the resultant mixture was stirred for 5 minutes at 2,000 rpm by means of a homomixer (manufactured by Tokushu Kika Kogyo Co., Ltd.). The mixed dispersion was applied onto the ink-receiving layer of the recording medium produced in Example 1 and dried to form a porous silica layer having a thickness of 10 $\mu$m. The resultant recording medium was evaluated in the same manner as in Examples 1 to 9. As a result, the transparency, resistance to curling before printing, resistance to curling after printing and the like remained unchanged. Further, tack and scuff marks did not occur.

EXAMPLE 11

Colloidal silica (Snowtex YL, trade name, product of Nissan Chemical Industries, Ltd.) and ultrafine particulate colloidal silica (Snowtex UP, trade name, product of Nissan Chemical Industries, Ltd.) as a binder were mixed with each other so as to give a mixing ratio of 1:1 in terms of solids content, and the resultant mixture was subjected to a dispersion treatment in the same manner as in Example 1, thereby obtaining a dispersion. This dispersion was applied onto the ink-receiving layer of the recording medium produced in Example 1 in the same manner as in Example 10 and dried to form a silica layer having a thickness of 10 $\mu$m. The resultant recording medium was evaluated in the same manner as in Examples 1 and 10. As a result, the same results as in Example 10 were obtained.

EXAMPLE 12

Gel type silica (P-78A, trade name, product of Mizusawa Industrial Chemicals, Ltd.) was dispersed in ion-exchanged water to obtain a dispersion at a solids concentration of 10% by weight. This dispersion and the same polyvinyl alcohol dispersion as that used in Example 1 were mixed at a mixing ratio of 3:1 in terms of solids content, and the resultant mixture was subjected to a dispersion treatment in the same manner as in Example 1, thereby obtaining a mixed dispersion. This dispersion was applied onto the ink-receiving layer of the recording medium produced in Example 1 in the same manner as in Example 10 and dried to form a silica layer having a thickness of 10 $\mu$m. The resultant recording medium was evaluated in the same manner as in Examples 1 and 10. As a result, the same results as in Example 10 were obtained.

The present invention has the following marked effects.

1. Since the ultrahigh orienting alumna hydrate according to the present invention has a boehmite structure, the recording media according to the present invention can provide printed image excellent in resolution, coloring and tinting, and moreover are excellent in transparency.

2. Since the ultrahigh orienting alumna hydrate according to the present invention has self-film-forming property, there can be provided recording media which scarcely cause curling before printing, curling after printing and environmental curing. In addition, the occurrence of coating defects in an ink-receiving layer can be prevented. Further, coating speed can be increased because the coating formulation containing such an alumna hydrate sets, so that productivity can be improved.

3. Blow marking, cracking by folding, and dusting are hard to occur. Even when the ink-receiving layer is marred, the marred portion thereof becomes hard to be separated.

What is claimed is:

1. A recording medium comprising a substrate and an ink-receiving layer provided on the substrate, wherein the ink-receiving layer essentially consists of a binder and an alumina hydrate obtained through a quenching step, the alumina hydrate having a boehmite structure and a flat plate form, an average particle thickness of 3.0 to 5.0 nm and a crystallite size of 5.0 to 8.0 nm in a direction of a (020) plane, the crystallite size in the direction of the (020) plane being greater than the average particle thickness by at least 1 nm, and the recording medium has a degree of parallelization of 30 to 1,000.

2. The recording medium according to claim 1, wherein the degree of parallelization is 50 to 800.

3. An image forming process, comprising the step of ejecting an ink from minute orifices to apply the ink to the recording medium according to claim 1 or 2.

4. The image forming process according to claim 3, which comprises applying thermal energy to the ink to eject the ink from the minutes orifices.

5. The recording medium according to claim 1, wherein the maximum peak in the pore radius distribution of the ink-receiving layer is present within a range of from 5.0 to 10.0 nm, and the pore volume thereof is within a range of from 0.35 to 1.0 $cm^3/g$.

6. The recording medium according to claim 1, which has a porous layer on the ink-receiving layer.

7. The recording medium according to claim 6, wherein the porous layer comprises silica.

8. The recording medium according to claim 1, wherein the ratio by weight of the alumina hydrate to the binder is from 7:1 to 15:1.

9. A process for producing a recording medium, which comprises the steps of:

mixing a slurry of an alumina hydrate obtained through a quenching step and having a boehmite structure and a flat plate form, an average particle thickness of 3.0 to 5.0 nm and a crystallite size of 5.0 to 8.0 nm in a direction of a (020) plane, the crystallite size in the direction of the (020) plane being greater than the average particle thickness by at least 1 nm, with a binder without drying the slurry to powder, applying the resultant mixture to a substrate, and drying the mixture, wherein the recording medium has a degree of parallelization of 30 to 1,000.

* * * * *

UNITED STATES PATENT AND TRADEMARK OFFICE

CERTIFICATE OF CORRECTION

PATENT NO. : 6,945,646 B2
APPLICATION NO. : 09/401659
DATED : September 20, 2005
INVENTOR(S) : Hiroyuki Ogino et al.

It is certified that error appears in the above-identified patent and that said Letters Patent is hereby corrected as shown below:

Column 1

Line 10, “high having” should read --having high--.

Column 2

Line 4, “have to a” should read --have a--.

Column 3

Line 28, “non- crystalline” should read --non-crystalline--.

Column 4

Line 66, “X-ray,” should read --X-ray--.

Column 5

Line 3, “set: to” should read --set to--.
Line 6, “referred to” should read --referred to as--.
Line 46, “to be left” should read --to leave--.

Column 6

Line 42, “that a” should read --such that a--.
Line 58, “ink receiving” should read --ink-receiving--.
Line 63, “ink receiving” should read --ink-receiving--.

Column 8

Line 45, “ea preferable” should read --a preferable--.

Column 9

Line 4, “comprises” should read --comprise--.
Line 56, “54-59936, in.” should read --54-59936, in--.

Column 10

Line 57, “(200)planes” should read --(200) planes--.

UNITED STATES PATENT AND TRADEMARK OFFICE

CERTIFICATE OF CORRECTION

PATENT NO. : 6,945,646 B2
APPLICATION NO. : 09/401659
DATED : September 20, 2005
INVENTOR(S) : Hiroyuki Ogino et al.

It is certified that error appears in the above-identified patent and that said Letters Patent is hereby corrected as shown below:

Column 12

Line 5, “was; observed;” should read --was observed;--.
Line 17, “gauge” should read --of warpage by a height gauge--.

Column 14

Line 14, “ion- exchanged” should read --ion-exchanged--.

Column 18

Line 32, “minutes” should read --minute--.

Signed and Sealed this

Thirty-first Day of October, 2006

JON W. DUDAS
*Director of the United States Patent and Trademark Office*